United States Patent [19]

Squatrito

[11] Patent Number: 4,962,775

[45] Date of Patent: Oct. 16, 1990

[54] CUSHION WRAP PAPER FOR PERMANENT WAVE HAIRSTYLING AND DISPENSER

[76] Inventor: Joseph Squatrito, 116 Corbin Ave., Staten Island, N.Y. 10308

[21] Appl. No.: 146,308

[22] Filed: Jan. 21, 1988

[51] Int. Cl.[5] ..... A45D 8/00

[52] U.S. Cl. ..... 132/222; 132/246

[58] Field of Search ..... 132/222, 223, 211-207, 132/246

[56] References Cited

U.S. PATENT DOCUMENTS

| | | | |
|---|---|---|---|
| 1,612,911 | 1/1927 | Durnerin | 132/246 |
| 1,643,035 | 9/1927 | Stahl | 132/246 |
| 1,824,883 | 9/1931 | Fulton | 132/246 |
| 1,951,658 | 3/1934 | Humphrey | 132/246 |
| 1,994,099 | 3/1935 | Fulton | 132/246 |
| 2,041,641 | 5/1936 | Grasso | 132/211 |
| 2,151,692 | 3/1939 | Evans et al. | 132/222 |
| 2,166,386 | 7/1939 | Auster | 132/246 |
| 2,720,207 | 10/1955 | Burtnett | 132/246 |
| 3,548,842 | 12/1970 | McCall | 132/222 |

*Primary Examiner*—Kenneth J. Dorner

*Assistant Examiner*—J. Hakomaki

*Attorney, Agent, or Firm*—Anthony J. Casella; Gerald E. Hespos

[57] ABSTRACT

An L-shaped cushion wrap paper is provided to afford protection to hair during permanent wave styling operations. The L-shaped cushion wrap paper comprises an elongated generally rectangular cushion strip and a flap extending generally orthogonally therefrom. The flap may be folded relative to the cushion strip to engage a plurality of strands of hair therebetween. The L-shaped cushion wrap paper facilitates the alignment of the cushion strip with the hair for winding onto a permanent wave roller, and provides enhanced protection to the hair and a neater overall appearance. A pair of identical L-shaped cushion wrap sheets may be efficiently cut from a single rectangular sheet with no wastage. A plurality of such sheets can be stored in and dispensed from a generally rectangular carton having removable access panels at opposed ends thereof. The carton may further comprise elongated stops disposed therein to maintain orderly stacked arrays of the L-shaped cushion wrap sheets of paper.

3 Claims, 2 Drawing Sheets

CUSHION WRAP PAPER FOR PERMANENT WAVE HAIRSTYLING AND DISPENSER

BACKGROUND OF THE INVENTION

Permanent wave hairstyling typically refers to a multi-step process for imparting a long lasting styled pattern of waves or curls to hair. The multi-step permanent wave hairstyling process typically involves the initial washing of the hair and scalp with appropriate shampoo and a thorough rinsing of the hair and scalp with water to remove both the shampoo and the oil and dirt lifted from the hair and scalp by the sudsing action. A permanent wave lotion is then applied to the hair. In particular, the permanent wave lotion is a commercially available caustic chemical that reacts with the hair to permanently accept a specific waved or curled orientation. The hair is then wound onto generally cylindrical rollers with the roller size, number, spatial orientation and rolling direction being selected by the hairdresser to achieve a particular desired hairstyle. The rolled hair is then saturated again with the permanent wave lotion. The hair remains in this rolled and saturated condition for a period of time determined by the specific permanent wave lotion employed and the intended hairstyle. The hair is then flushed with water to remove excess permanent wave lotion and a neutralizer is applied to terminate the chemical reaction of the permanent wave lotion on the hair. The rollers are then removed from the hair, and the hair is rinsed, dried and styled in accordance with the pattern of waves and curls imparted by the above described process.

The hairdresser must be careful to ensure that the hair is not damaged by the caustic permanent wave lotion. For example, direct and extended contact between the permanent wave lotion and the ends of the hair is known to cause frizzing. Similarly, the elastic means used to retain the hair in the rolled condition can cause a permanent mark on the hair if the elastic means directly contacts portions of the hair that have been saturated with permanent wave lotion.

Hairstylists typically employ ends paper to prevent the permanent wave lotion from damaging or frizzing the ends of the hair. More particularly, ends paper is a fine flexible paper that will maintain its structural integrity when saturated with water and permanent wave lotion. The prior art ends paper is sold commercially in small rectangular sheets typically about four inches wide and about three inches long. The hairstylist uses the prior art ends paper by folding the paper in half around its short axis to define a folded sheet approximately two inches by three inches. The distal ends of the hair then are disposed intermediate the folded halves of the ends paper, with the paper extending at least about one-half inch beyond the distal ends of the hair. The hair and the paper then are rolled onto the permanent wave roller.

The prior art ends paper has several disadvantages. For example, as its name suggests, the prior art ends paper is dimensioned to protect only the distal ends of the hair from the frizzing that would otherwise be caused by the permanent wave lotion. However, the prior art ends paper is not dimensioned to protect all of the lotion saturated hair from damage that could be caused by the substantial hair-to-hair contact pressure as the rolling of the hair continues toward the scalp. Furthermore, and importantly, the prior art ends paper has not been designed to protect the portion of the hair near the scalp from the elastic attachment means for retaining the hair in its rolled condition.

The inventor herein has recognized these deficiencies of the prior art ends paper, and has attempted to use several sheets of the prior art small rectangular paper sheets in a partially overlapping end-to-end relationship along the length of the strands of hair being rolled. Thus, a first sheet of the prior art paper would be generally aligned with the strands of hair near their distal ends. This prior art ends paper typically would extend only a small part of the length of the hair. The prior art paper and hair would then be rolled until the end of the first sheet of paper was approached. A second sheet of the prior art rectangular ends paper would then be placed in partially overlapping end-to-end relationship with the first sheet and rolling would proceed. This rolling process would continue, with the number of sheets of prior art paper being generally proportional to the length of the hair being styled.

These attempts to employ the prior art paper along the entire length of the hair were very slow and resulted with functional inefficiency and an unprofessional appearance. In particular, it is extremely difficult to align the prior art rectangular ends paper with the axis of the hair to be rolled. These alignment problems are at least partly attributable to the slippery characteristics of the wet hair, the desire of the hairstylist to move quickly and the short length of the paper. The misalignment of the prior art rectangular ends paper generally results in the hair being wound into a helix with a zero degree pitch and the prior art ends paper being wrapped into a helix with a pitch equal to the angular misalignment between the hair and the prior art paper. Thus, hair at one end of the roller may not be adequately protected by the prior art ends paper while the paper extends beyond the opposed end of the roller and the hair adjacent thereto. This misalignment is functionally undesirable and presents an unprofessional image for the hairstylist.

The prior art has included virtually no attempts to overcome the above described deficiencies of ends paper for permanent wave hairstyling. One reference that did attempt to facilitate the application of ends paper is U.S. Pat. No. 2,087,181 which issued to Conway on Jul. 13, 1937. This reference employs the above described inefficient and undesirable small rectangular sheets of paper for use in hairstyling applications. The reference is directed primarily to a dispensing package that can be clipped to a previously rolled portion of the hair to somewhat facilitate the use of the awkward sheets described above.

In view of the above, it is an object of the subject invention to provide an improved paper for permanent waves and hairstyling.

Another object of the subject invention is to provide a permanent wave paper that can be readily aligned with the hair.

An additional object of the subject invention is to provide a paper that affords adequate cushioning protection to the hair along substantially the entire length of the hair being wrapped onto the roller.

A further object of the subject invention is to provide a permanent wave paper that enables a neater and more professional appearance when in use.

Still another object of the subject invention is to provide a permanent wave paper that achieves optimum protection of the hair without wasting paper.

Yet another object of the subject invention is to provide a permanent wave paper that is readily adaptable to hair of different lengths.

Another object of the subject invention is to provide an efficient dispenser for paper to be used in permanent wave hairstyling.

Still another object of the subject invention is to protect the hair from damage by the elastic means used to retain the hair in the rolled condition.

SUMMARY OF THE INVENTION

The subject invention is directed to a permanent wave hairstyling paper of generally L-shaped configuration, which in view of its unique structure and function, will be identified herein as cushion wrap paper. More particularly, the cushion wrap paper comprises a unitary L-shaped sheet with a pair of legs which may be generally orthogonal to one another. One leg of the L-shaped cushion wrap paper defines a flap for aligning the paper to the hair and for protecting the surface of the hair that would otherwise be disposed in direct contact with the roller. The other leg of the L-shaped paper defines a longitudinal cushion strip for placement parallel to the hair to be rolled.

The cushion strip of the subject L-shaped cushion wrap paper may have a width approximately equal to or slightly less than the length of the roller to be employed for the permanent wave. The length of the cushion strip would be selected in accordance with the length of the hair. In a preferred embodiment a plurality of alternate L-shaped cushion wrap papers would be provided with the length of the cushion strip being selected in accordance with the length of the hair. In this embodiment, the cushion strip length typically would be between approximately 4 inches and 12 inches.

The flap would have a length from the intersection with the cushion strip substantially equal to the width of the cushion strip. The width of the flap preferably would be approximately 2 inches.

In use, the flap would be folded along a line extending parallel to the axis of the cushion strip such that the fold line is approximately collinear with the shorter longitudinal edge of the cushion strip. The L-shaped cushion wrap paper then would be placed with the cushion strip on one side of a plurality of strands of hair to be rolled and with the flap on the other side. The elongated cushion strip facilitates proper alignment of the paper to the hair. Furthermore, the engagement of both sides of the wet and slippery hair at the start of the rolling substantially enhances the ability to attain and maintain alignment of the cushion strip to the hair. The roller is then placed adjacent the flap such that the flap is disposed intermediate the roller and the hair to provide protection to the initial turn of the hair around the roller. The hair would be rolled in this properly aligned orientation. An L-shaped cushion wrap paper of appropriate dimension would be selected to ensure that the cushion strip extends at least the entire length of the hair.

The above described configuration of the L-shaped cushion wrap paper enables two identical L-shaped cushion wrap papers to be formed from a single rectangular sheet. Thus, the free end of the cushion strip would initially be disposed adjacent the flap of the other L-shaped cushion wrap paper cut from the rectangular sheet. The cuts required to form two L-shaped cushion wrap papers from a single rectangular sheet can be readily completed with appropriate automatic cutting apparatus.

A dispenser carton for the L-shaped cushion wrap paper may be formed from a sheet of paperboard material. More particularly, the dispenser carton may be of generally rectangular configuration with a pair of opposed end walls, opposed top and bottom walls and opposed front and rear walls. The top and bottom walls may be dimensioned to receive a pair of the L-shaped cushion wrap papers in their cut, but nested, configuration. Thus, two nested stacks of L-shaped cushion wrap paper may be stored in the carton. The opposed end walls of the carton may be provided with appropriate arrays of perforations to enable each end to be selectively opened. Thus, the L-shaped cushion wrap papers could initially be removed from one opened end of the carton, with the opposed end remaining shut. When the cushion wrap papers have been removed from the one end of the dispenser carton, the opposed end can be opened to enable sequential removal of the L-shaped cushion wrap papers therefrom. Furthermore, the dispenser carton may be inverted to alter the orientation of the flap by 180°. The particular orientation of the flap would be selected in accordance with the preferences of the hair stylist, for example, based on a left-handed or right-handed preference, or on the side of the customer's head being styled.

The dispenser carton may be provided with vertical stops to maintain the alignment of the respective nested stacks of the L-shaped cushion wrap paper. The stops may comprise deep score lines in the front and rear walls of the carton, or may alternately comprise separate stop panels adhered to the inner surfaces of the front and rear walls at appropriate locations.

DETAILED DESCRIPTION OF THE PREFERRED EMBODIMENTS

Figure 1:
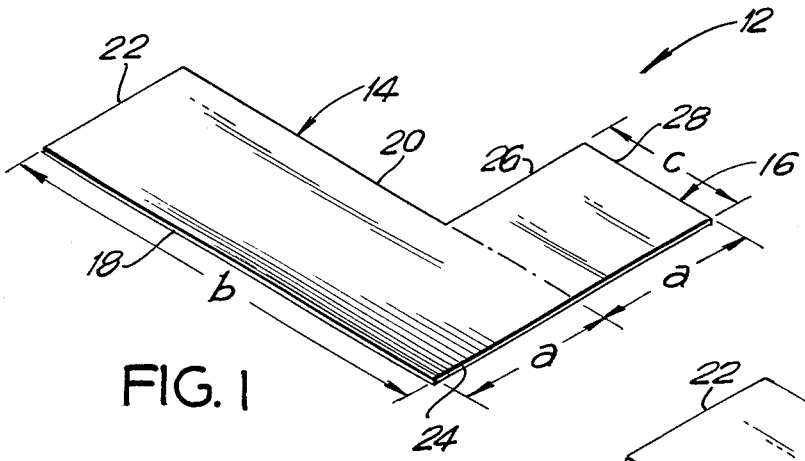
FIG. 1 is a perspective view of the L-shaped cushion wrap paper of the subject invention in its unfolded configuration.

The L-shaped cushion wrap paper of the subject invention is identified generally by the numeral 12 in FIG. 1. The L-shaped cushion wrap paper 12 is a unitary sheet of paper stock referred to generally in the trade as cushion wrap paper, and has the ability to retain its structural integrity when saturated by water, permanent wave lotion, neutralizers and other such liquids.

The cushion wrap paper 12 generally comprises a cushion strip 14 and a flap 16. More particularly, cushion strip 14 of the L-shaped cushion wrap paper 12 comprises opposed generally parallel longitudinally extending major and minor strip side edges 18 and 20 and a base end edge 22 extending between the major and minor strip side edges 18 and 20. A distal end edge 24 extends orthogonally from the major strip side edge 18 and defines the end of the L-shaped cushion wrap paper 12 opposite the base end edge 22. A flap side edge 26 extends orthogonally from the minor strip side edge 20 and generally parallel to the distal end edge 26, and a flap end edge 28 extends between the edges 24 and 26 to define the remainder of the perimeter of the L-shaped cushion wrap paper 12.

The cushion strip 14 of the L-shaped cushion wrap paper 12 has a width "a", as measured orthogonally between the major and minor strip side edges 18 and 20, which is selected in accordance with the length of the roller to be used for the permanent wave. In the typical situation, the cushion strip 14 will have a width "a" approximately equal to 2.125 inches. The cushion strip 14 will have a length "b" measured between the base end edge 22 and the distal end edge 24. The dimension "b" will be selected in accordance with the length of the hair with which the cushion wrap paper 12 will be employed. Typically, the length of the cushion strip 14, as indicated by dimension "b", will be between 3 inches and 12 inches. In a particularly preferred embodiment, the L-shaped cushion wrap paper will be manufactured in three separate sizes for short, medium and long hair. The short hair version of the L-shaped cushion wrap paper 12 will have a cushion strip 14 with a length "b" approximately equal to 4 inches. The version of the L-shaped cushion wrap paper 12 for medium length hair will have a cushion strip 14 with a length "b" approximately equal to 6 inches, while a third version for long hair will have a length "b" approximately equal to between 10 inches and 12 inches.

Figure 2:
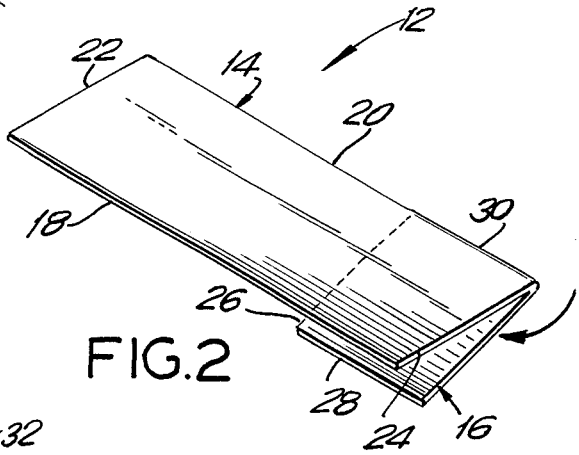
FIG. 2 is a perspective view of the L-shaped cushion wrap paper in its folded condition.

The flap 26 of the L-shaped cushion wrap paper 12 has a width measured along the flap end edge 28 of approximately 2 inches as indicated by dimension "c". The width "c" of the flap 16 will enable the cushion wrap paper 12 to be disposed intermediate the hair and the permanent wave roller as explained further below. The flap 16 has a length measured along the flap side edge 26 of dimension "a" which is substantially equal to the width "a" of the cushion strip 14 as explained above. As a result of these dimensions, the flap 16 may be folded about a line extending collinearly from the minor strip side edge 20 to place the flap end edge 28 substantially in register with the major strip side edge 18, as shown most clearly in FIG. 2. As a result, a fold line 30 is defined generally collinear with the minor strip side edge 20.

The L-shaped cushion wrap paper 12 is used in combination with a permanent wave roller 32 as shown in FIGS. 3–7. The roller 32 includes a slightly concave generally cylindrical body 34 having a fastener 36 attached to one longitudinal end thereof by an elastic connector 38. The fastener 36 is dimensioned to be frictionally retained in an aperture 40 in the opposed longitudinal end of the generally cylindrical body 34.

Figure 3:
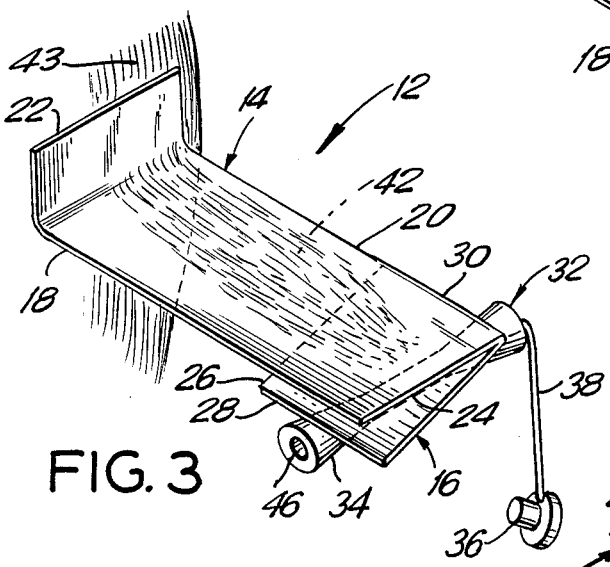
FIG. 3 is a perspective view of the L-shaped cushion wrap paper engaging a plurality of strands of hair and in proximity to a permanent wave roller.

The L-shaped cushion wrap paper 12 is used by folding the flap 16 onto the cushion strip 14 substantially as shown in FIG. 3 to define the fold line 30. In this folded configuration, the cushion wrap paper 12 defines a generally elongated rectangular profile. A plurality of strands of hair 42 are then engaged between the cushion strip 14 and the flap 16 as shown in FIG. 3. More particularly, the hair 42 is pulled away from the scalp 43 and is engaged between the cushion strip 14 and the flap 16 such that the cushion strip 14 is on top. The L-shaped cushion wrap paper 12 is selected such that an approximately ½ inch section of cushion strip 14 adjacent the base end edge 22 lies against the scalp 43, and such that the distal end edge 24 extends slightly beyond the ends of hair 42. The ability to grip the hair 42 between the cushion strip 14 and the flap 16 substantially minimizes sliding that would otherwise occur between the cushion wrap paper and the wet and slippery hair 42, provides greater control of the alignment between the hair 42 and the cushion strip 14 and will ensure a neater rolled arrangement as explained further below.

Figure 4:
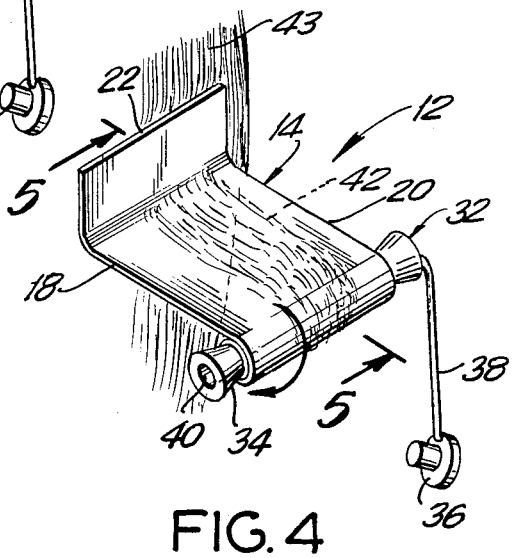
FIG. 4 is a perspective view showing a partially completed rolling of the cushion wrap paper and hair onto the permanent wave roller.
Figure 6:
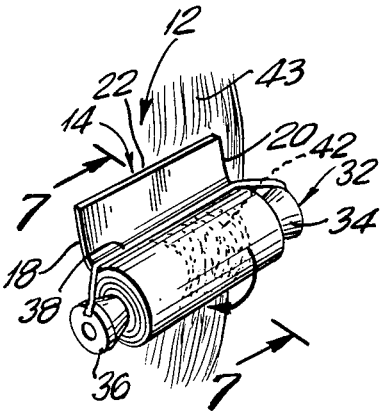
FIG. 6 is a perspective view of the cushion wrap paper and hair fully wound onto the permanent wave roller.
Figure 5:
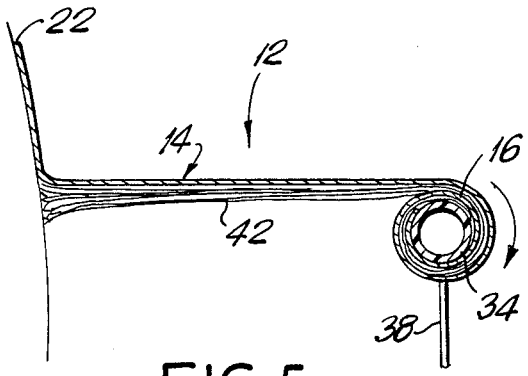
FIG. 5 is a cross-sectional view taken along line 5—5 in FIG. 4.
Figure 7:
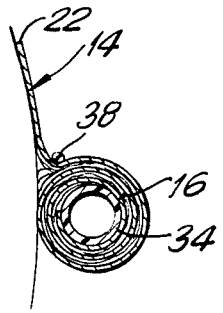
FIG. 7 is a cross-sectional view taken along line 7—7 in FIG. 6.

As shown in FIG. 3, the permanent wave roller 32 is disposed such that the generally cylindrical body 34 is adjacent the flap 16 of cushion wrap paper 12 and aligned generally transverse to the axis of the cushion strip 14. The strands of hair 42 with the L-shaped cushion wrap paper 12 foldably engaged thereabout is then rolled onto the generally cylindrical body 34 by rotating the roller 32 as shown in FIG. 4. This rotation is such that the cushion strip 14 is always on the outside of the roll and protects each rolled layer of hair from subsequently wound layers as shown most clearly in FIG. 5. The rolling continues until the permanent wave roller 32 is substantially adjacent the scalp as shown in FIGS. 6 and 7. At this point, the elastic connector 38 is stretched across the wound hair 42 such that the fastener 36 can be engaged into the aperture 40. The cushion strip 14 is disposed intermediate the last layer of hair 42 and the elastic connector 38 to prevent pressure related damage to the hair 42 by the elastic connector 38.

Figure 8:
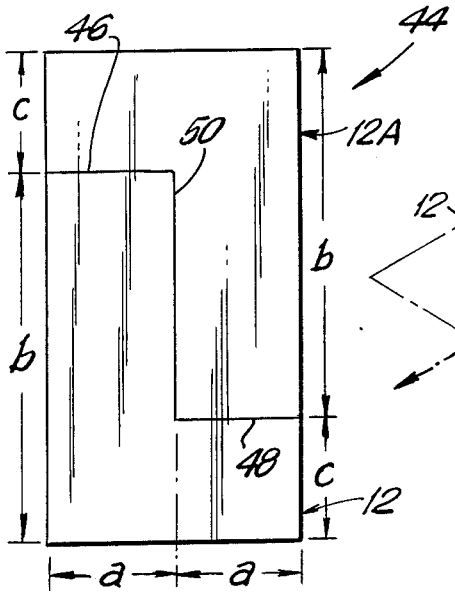
FIG. 8 is a top plan view of a pair of nested sheets of L-shaped cushion wrap paper.

The L-shaped cushion wrap paper 12 preferably is cut from a rectangular sheet 44 as shown in FIG. 8. More particularly, the rectangular sheet 44 is provided with transverse cut lines 46, 48 and longitudinal cut 50 which extend entirely through the rectangular sheet 44 to define the first L-shaped cushion wrap paper 12 described above and a second L-shaped cushion wrap paper 12A substantially identical to and efficiently nested with the first paper 12.

Figure 9:
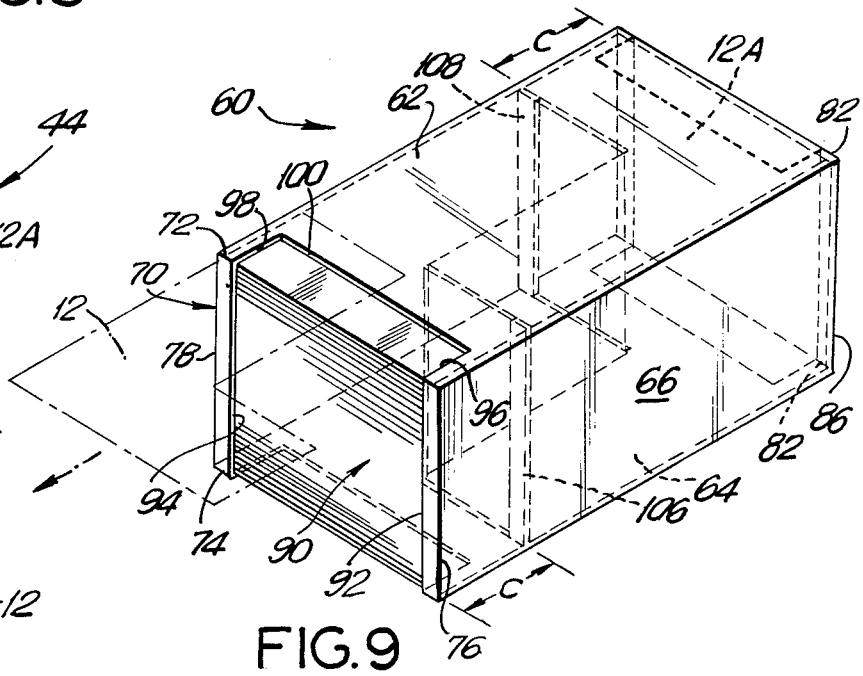
FIG. 9 is a perspective view of a dispenser carton with a first end opened.
Figure 10:
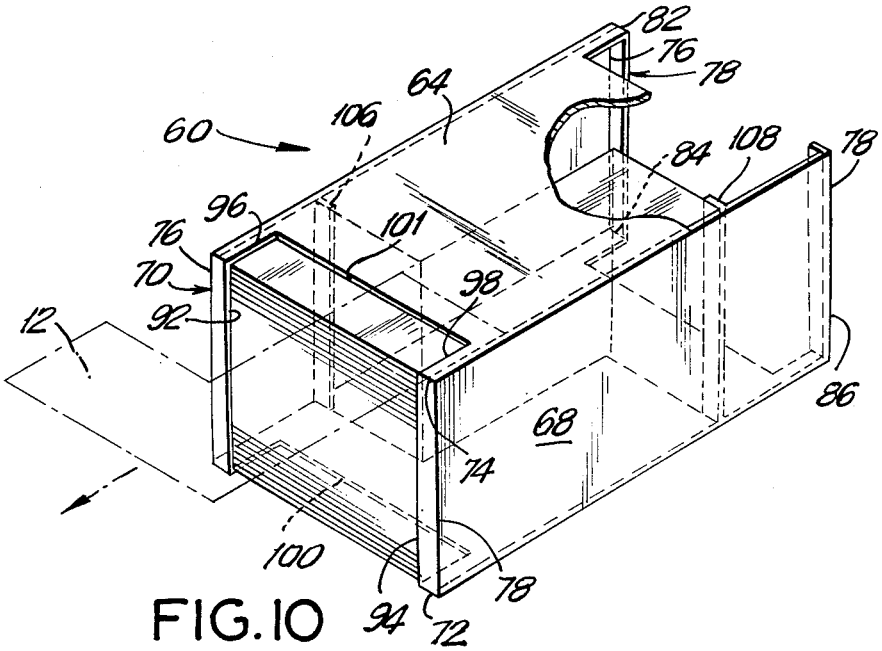
FIG. 10 is a perspective view of a dispenser carton with both ends opened.

A dispenser carton for a stacked and nested plurality of L-shaped cushion wrap papers 12 and 12A is shown in FIGS. 9 and 10 and is indicated generally by the numeral 60. The carton 60 includes opposed generally parallel top and bottom walls 62 and 64, and opposed generally parallel front and rear walls 66 and 68 which extend between and are connected to the top and bottom walls 62 and 64. Opposed generally parallel end walls 70 and 71 extend between and are connected to the top and bottom walls 62 and 64 and the opposed front and rear walls 66 and 68. More particularly, the end wall 70 is connected to the top and bottom walls 62 and 64 along generally parallel fold lines 72 and 74, and is connected to the opposed front and rear walls 66 and 68 along parallel fold lines 76 and 78 respectively. Similarly, the end wall 71 is connected to the top and bottom walls 62 and 64 along fold lines 82 and 84 respectively and is connected to the opposed front and rear walls 66 and 68 along fold lines 86 and 88 respectively.

The dispenser carton 60 is characterized by a pair of opposed removable access panel assemblies for obtaining access to the L-shaped cushion wrap papers 12 and 12A stored in the carton 60. In particular, the access panel assembly 90 is defined by perforation lines 92 and 94 which are parallel to and slightly spaced from the fold lines 76 and 78 respectively and extend the entire distance between the fold lines 72 and 74 along the end wall 70. Perforation lines 96 and 98 extend a short distance on the top wall 62 as extensions of the perforation lines 92 and 94. A transverse perforation line 100 extends generally parallel to the fold line 72 and connects the ends of the perforation lines 96 and 98. A similar array of perforation lines is disposed in the portion of the bottom wall 64 adjacent the fold line 74.

An access panel assembly 101 is defined by a similar array of perforation lines in the end wall 71 and in portions of the top wall 62 and bottom wall 64. As a result of this construction, the access panel assemblies 90 or 101 may be selectively removed from the carton 60 to provide access to the L-shaped cushion wrap paper 12 and 12A stored therein, as shown by the broken lines in FIG. 9. In particular, the removal of the access panel assembly 90 enables the L-shaped cushion wrap paper sheets 12 to be sequentially removed from the end of the carton 60 defined by end wall 70. Upon exhaustion of the supply of the L-shaped cushion wrap paper sheets 12, the access panel assembly 101 may be removed therefrom. As a result, the L-shaped cushion wrap paper sheets 12A may then be sequentially removed from the dispenser carton 60.

FIG. 10 shows the carton 60 inverted such that the bottom wall 64 is facing upwardly. A comparison of FIGS. 9 and 10 shows that in the FIG. 9 orientation of carton 60, the flap 16 of paper 12 extends to the right, while in the FIG. 10 orientation the flap 16 extends to the left. Thus, by inverting the carton 60 the flap 16 can be oriented for the most efficient use and manipulation by the hairstylist. For example, the carton disposition as shown in FIGS. 9 and 10 may be determined by the portion of the customer's head to be styled and/or by the dexterity of the stylist. This ability to achieve different orientations results from the unique configurations of the cushion wrap papers 12, the carton 60, the access panel assemblies 90 and 101 and the cooperation between the respective configurations.

To keep the respective sheets of L-shaped cushion wrap paper 12 and 12A in orderly stacked arrays, the carton 60 is provided with stops 106 and 108 which are disposed on the interior of carton 60 generally in line with the cut lines 46 and 48 respectively defining the papers 12 and 12A. More particularly, the stops 106 and 108 are disposed on the respective front and rear walls 66 and 68 and extend parallel to the end walls 70 and 71 substantially the entire distance between the top and bottom walls 62 and 64. The stops 106 and 108 are spaced from the respective end walls 70 and 71 by a distance "c" which is substantially equal to the width of the flap 16 on each sheet of L-shaped cushion wrap paper 12 and 12A. The stops 106 and 108 may be defined by any structure suitable for maintaining the respective sheets 12 and 12A in an orderly stacked array. For example, the stops 106 and 108 may be defined by deep score lines in the respective front and rear walls 66 and 68. Alternatively, the stops 106 and 108 may be defined by flaps cut into the respective front and rear walls 66 and 68 and folded inwardly prior to placing the sheets 12 and 12A in the carton 60. As still another alternative, the stops 106 and 108 may define separate structural members adhered or otherwise secured on the interior of the carton 60 in the location described above.

In summary, an L-shaped cushion wrap paper is provided for use with permanent wave rollers. The L-shaped cushion wrap paper comprises an elongated generally rectangular cushion strip and a flap orthogonally disposed to the cushion strip. The flap may be folded relative to the cushion strip to engage a plurality of strands of hair therebetween. The combination of the hair and the folded L-shaped cushion wrap paper can then be wound onto a permanent wave roller. The L-shaped cushion wrap paper facilitates the alignment of the paper with the hair and enhances the protection afforded by the paper. Two L-shaped cushion wrap sheets of paper may be conveniently and efficiently cut from a single rectangular sheet of paper with no wastage. A plurality of such sheets can be conveniently stored and dispensed from a dispenser carton having access panels removable from opposed ends. The dispenser carton may include stops disposed therein to maintain an orderly stacked array of the sheets.

While the invention has been described with respect to certain preferred embodiments, it is apparent that various changes can be made without departing from the scope of the invention as defined by the appended claims.

What is claimed is:

1. A plurality of stacked elongated rectangular sheets of cushion wrap paper, each sheet having opposed first and second parallel long side edges and opposed parallel end edges, each said sheet having a longitudinally extending cut line extending entirely through said sheet and disposed substantially midway between said side edges, said longitudinal cut line having opposed ends spaced inwardly from the respective end edges of said sheet by substantially equal distances, each said sheet further comprising first and second transverse cut lines extending respectively from the opposed ends of the longitudinal cut line to the respective first and second side edges, whereby said cut lines define first and second stacks of nested, generally L-shaped cushion wrap papers in said plurality of stacked rectangular sheets such that the stacked sheets may be stored in a dispenser carton having opposed removable ends for providing ready access to the end edges of the individual sheets of L-shaped cushion wrap paper disposed therein.

2. A sheet as in claim 1 wherein said transverse cut lines are spaced from the respective end edges by approximately 2 inches.

3. a sheet as in claim 1 wherein the end edges thereof are spaced apart by a distance of between approximately 6 inches and 14 inches.

* * * * *